US005511533A

United States Patent [19]

Waller

[11] Patent Number: 5,511,533

[45] Date of Patent: Apr. 30, 1996

[54] ADJUSTABLE HYDRAULIC STABILIZER FOR A BOW

[76] Inventor: Charles O. Waller, 6325 W. Larkspur, Glendale, Ariz. 85304

[21] Appl. No.: 191,090

[22] Filed: Feb. 3, 1994

[51] Int. Cl.[6] ..... F41B 5/20

[52] U.S. Cl. ..... 124/89; 188/380; 267/137

[58] Field of Search ..... 124/89; 267/136, 267/137; 42/1.06; 188/317, 322.15, 378, 380

[56] References Cited

U.S. PATENT DOCUMENTS

| | | | |
|---|---|---|---|
| 3,628,520 | 12/1971 | Izuta | 124/89 |
| 3,670,712 | 6/1972 | Izuta | 124/89 |
| 4,245,612 | 1/1981 | Finlay | 124/89 |
| 4,615,327 | 10/1986 | Saunders | 124/89 |
| 4,779,602 | 10/1988 | Hess | 124/89 |
| 4,893,606 | 1/1990 | Sisko | 124/89 |
| 4,945,666 | 8/1990 | Henry et al. | 124/89 |
| 4,982,719 | 1/1991 | Haggard | 124/89 |
| 4,986,018 | 1/1991 | McDonald, Jr. | 42/1.06 |

*Primary Examiner*—John A. Ricci
*Attorney, Agent, or Firm*—Lowell W. Gresham; Jordan M. Meschkow

[57] ABSTRACT

An adjustable stabilizer device for use on a bow to reduce and delay torque and other detrimental forces resulting from shooting thereof, including a housing containing a hydraulic component threadably carried therein. The hydraulic component includes a weight housing carrying a weight centered between opposing springs and moveably contained within hydraulic fluid. The adjustable stabilizer device is adjustable by moving the hydraulic component within the housing to counter differing forces generated by different bows.

21 Claims, 3 Drawing Sheets

ADJUSTABLE HYDRAULIC STABILIZER FOR A BOW

BACKGROUND OF THE INVENTION

1. Field of the Invention

This invention relates to Archery equipment.

More particularly, the present invention relates to a stabilizer for reducing vibration and torque during shooting of a bow.

In a further and more specific aspect, the present invention concerns an adjustable hydraulic stabilizer for use on a bow.

2. The Prior Art

Bows have been known for a great many years, and through all that time accessories have been developed to improve the accuracy and efficiency of the bow. The bow itself has also been improved, with modern technology increasing their power and strength. Stabilizers for reducing shock when a bow is shot have been used for many years. They were primarily developed to prevent wrist torque and consisted of weights extending forwardly from the bow. Wrist torque is rotation of the bow by an archers wrist after releasing a taught bow string. Rotation of a bow in this manner deflects the released arrow from its intended flight path. The use of a properly balanced stabilizer reduces and delays the movement of the bow, at least until the arrow passes the front of the bow. Of course, the stabilizer must be properly balanced or it will effect accuracy.

Modern bows, being generally more powerful, produce various other detrimental forces which cause movement of the bow. Furthermore, development of stronger materials for the handle riser of the bow has allowed design changes which, for some designs, cause significant torque. Offset handles are a major source of torque. For whatever reason, movement of a bow during shooting will detract from accuracy. Stabilizers have been developed which reduce torque more efficiently than older counterweighted stabilizers. The use of hydraulic stabilizers dampens bow vibration and is very useful in reducing most detrimental forces. The problem with these stabilizers is that they are relatively complicated to build, and are difficult to properly adjust and balance for each individual bow. Most stabilizers are constructed with a specific type of bow in mind, and due to their complicated construction, require a shop to make adjustments if adjustments can be made at all. Once fitted to a specific bow, a stabilizer cannot be used on another bow because the balance will probably not be correct and tailoring the stabilizer to the bow is expensive and time consuming.

It would be highly advantageous, therefore, to remedy the foregoing and other deficiencies inherent in the prior art.

Accordingly, it is an object of the present invention to provide a new and improved stabilizing device.

Another object of the present invention is to provide a durable stabilizing device.

And another object of the present invention is to provide a stabilizing device which reduces vibration and torque generated when shooting a bow.

Still another object of the present invention is to provide a stabilizing device which may be used on substantially any bow.

Yet another object of the present invention is to provide a stabilizing device which has an adjustable hydraulic component so that it may be transferable to different bows.

Yet still another object of the present invention is to provide a stabilizing device permitting micro adjustments when mounted for use on an individual bow.

A further object of the present invention is to provide a single housing having a threaded interior for accommodating all components.

And a further object of the present invention is to provide a housing through the end of which adjustments to the hydraulic component may be made.

Yet a further object of the present invention is to provide a stabilizing device which may be adjusted using a single wrench.

SUMMARY OF THE INVENTION

Briefly, to achieve the desired objects of the present invention in accordance with a preferred embodiment thereof, provided is an adjustable stabilizer device for use in combination with a bow. The adjustable stabilizer device includes a tubular housing having an attachment end and a free end, attachment means for attaching the tubular housing to the bow, and a hydraulic component adjustably carried within the tubular housing. The tubular housing has a threaded interior, and the hydraulic component has a threaded exterior configured to threadably engage the threaded interior thereby permitting adjustments in position. Also provided is a locking member threadably received within the housing and engaging the hydraulic component.

The hydraulic component includes a weight housing having an inner end and an outer end, a weight having an inner end and an outer end, slidably carried within the weight housing, and centering means for centering the weight within the weight housing. The hydraulic component is closed by an inner end cap having a bore formed therethrough for filling the weight housing with a fluid, the inner end cap coupled to the inner end of weight housing, a removable plug receivable within the bore and an outer end cap coupled to the outer end of the weight housing respectively.

The above problems and others are answered, and the above objects are further realized in a method of stabilizing a bow.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which.

DETAILED DESCRIPTION OF THE PREFERRED EMBODIMENT

Figure 1:
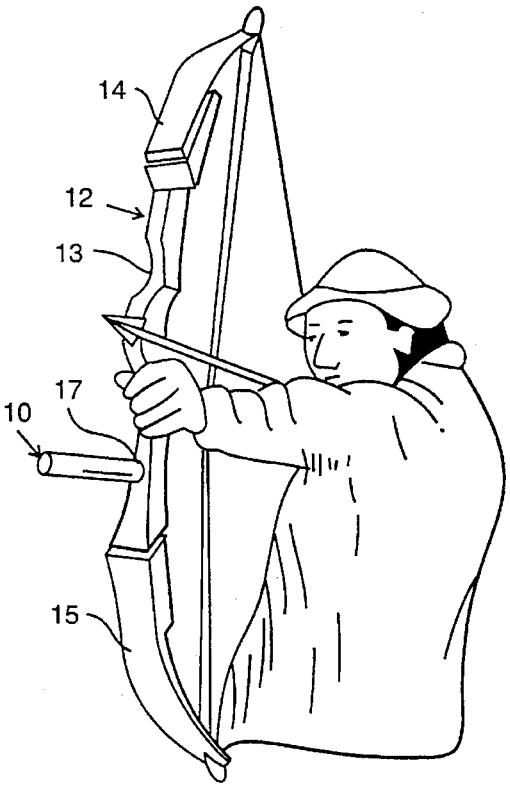
FIG. 1 is a perspective view of an adjustable stabilizing device constructed in accordance with the teachings of the instant invention as it would appear mounted on a bow.

Turning now to the drawings in which like reference characters indicate corresponding elements throughout the several views, attention is first directed to FIG. 1 which illustrates an adjustable stabilizer device generally designated by reference character 10. Adjustable stabilizer device 10 is shown coupled to and stabilizing a bow 12. Bow 12 includes a handle riser 13 having a top end and a bottom end from which a top limb 14 and a bottom limb 15 extend respectively. Adjustable stabilizer device 10 is coupled to a threaded bore 17 formed in the front of handle riser 13. Adjustable stabilizer device 10 functions to reduce and delay wrist torque generated by the archers grip, system torque generated by bow design and any other detrimental forces which may move bow 12.

Wrist torque is found on any type of bow, since it is not equipment related, and generally occurs when an archer flexes his/her bow hand into the bow upon release of the bow string. Even slight wrist movement can cause an arrow to deviate from its intended flight path. System torque is equipment related and will occur to different magnitudes on different bows and different bow designs. Other forces which cause movement of the bow also occur upon the release of the bow string. Anything which causes movement of the bow during release of an arrow will be detrimental to the flight of the arrow. Furthermore, each individual bow, bow design, and archer will generate different torques and detrimental forces. Adjustable stabilizer device 10 retards the movement of the bow, at least until the arrow has cleared the front of the bow, at which time bow movement will no longer influence the arrow.

Figure 2:
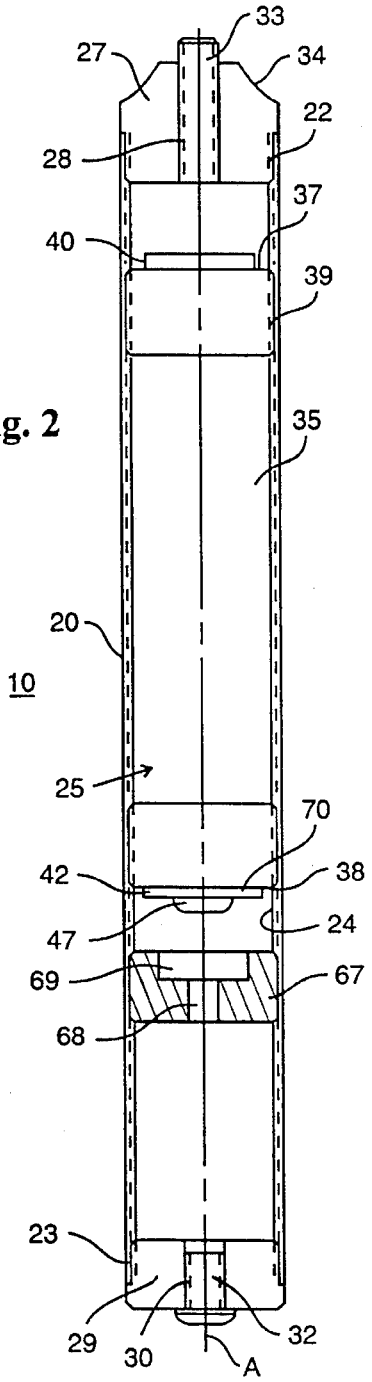
FIG. 2 is a sectional side view of the adjustable stabilizing device of FIG. 1.
Figure 3:
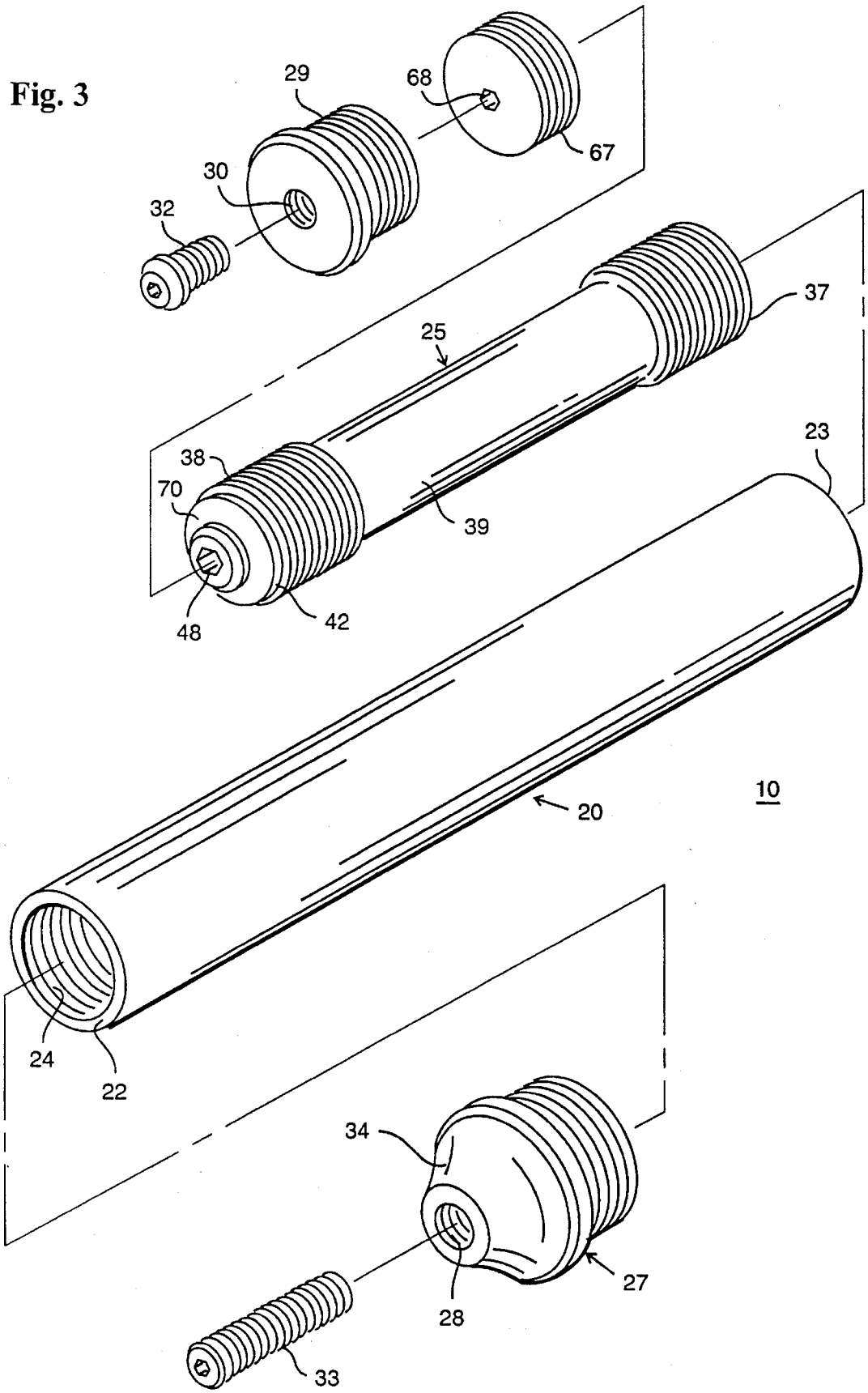
FIG. 3 is an exploded perspective view of the adjustable stabilizing device of FIGS. 1 and 2.

With reference now to FIGS. 2 and 3, adjustable stabilizer device 10 includes a tubular housing 20 having an attachment end 22, a free end 23, an inner surface 24 extending therebetween and a longitudinal axis illustrated by broken line A in FIG. 2. Inner surface 24 is threaded from attachment end 22 to free end 23 and is configured to threadably receive a hydraulic component 25. Attachment end 22 is closed by a threaded end cap 27 having a threaded bore 28 extending therethrough. End cap 27 is threadably received within attachment end 22 with threaded bore 28 extending generally along longitudinal axis A. Free end 23 is closed by an end cap 29 threadably received within free end 23. A threaded access hole 30 extends through end cap 29 generally along longitudinal axis A. Access hole 30 is closed by a dust plug 32 which is threadably received therein. The purpose for access hole 30 will be described below.

In the preferred embodiment, housing 20 and end caps 27 and 29 are fabricated from aluminum for its lightweight durability. One skilled in the art will appreciate, however, that many other types of materials may be used.

Housing 20 is coupled to bow 12 by a threaded member 33 threadably received by bore 28 of end cap 27 and bore 17 of bow 12. The majority of conventional bows are provided with a bore for the attachment of stabilizer devices. Threaded member 33 is preferably constructed to mate with a standardized thread. To further aid in attachment of housing 20 to bow 12, end cap 27 has a generally conical outer surface 34. This conical shape permits housing 20 to be closely fitted to bow 12, even when bore 17 is recessed.

Figure 4:
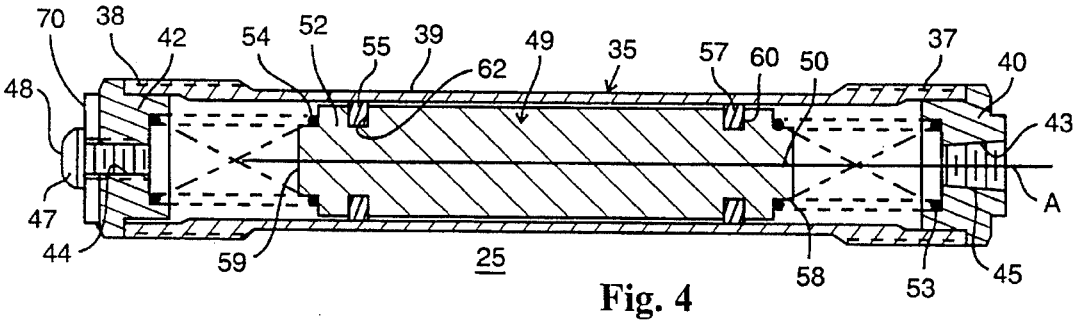
FIG. 4 is a sectional side view of a hydraulic component of the adjustable stabilizing device.
Figure 5:
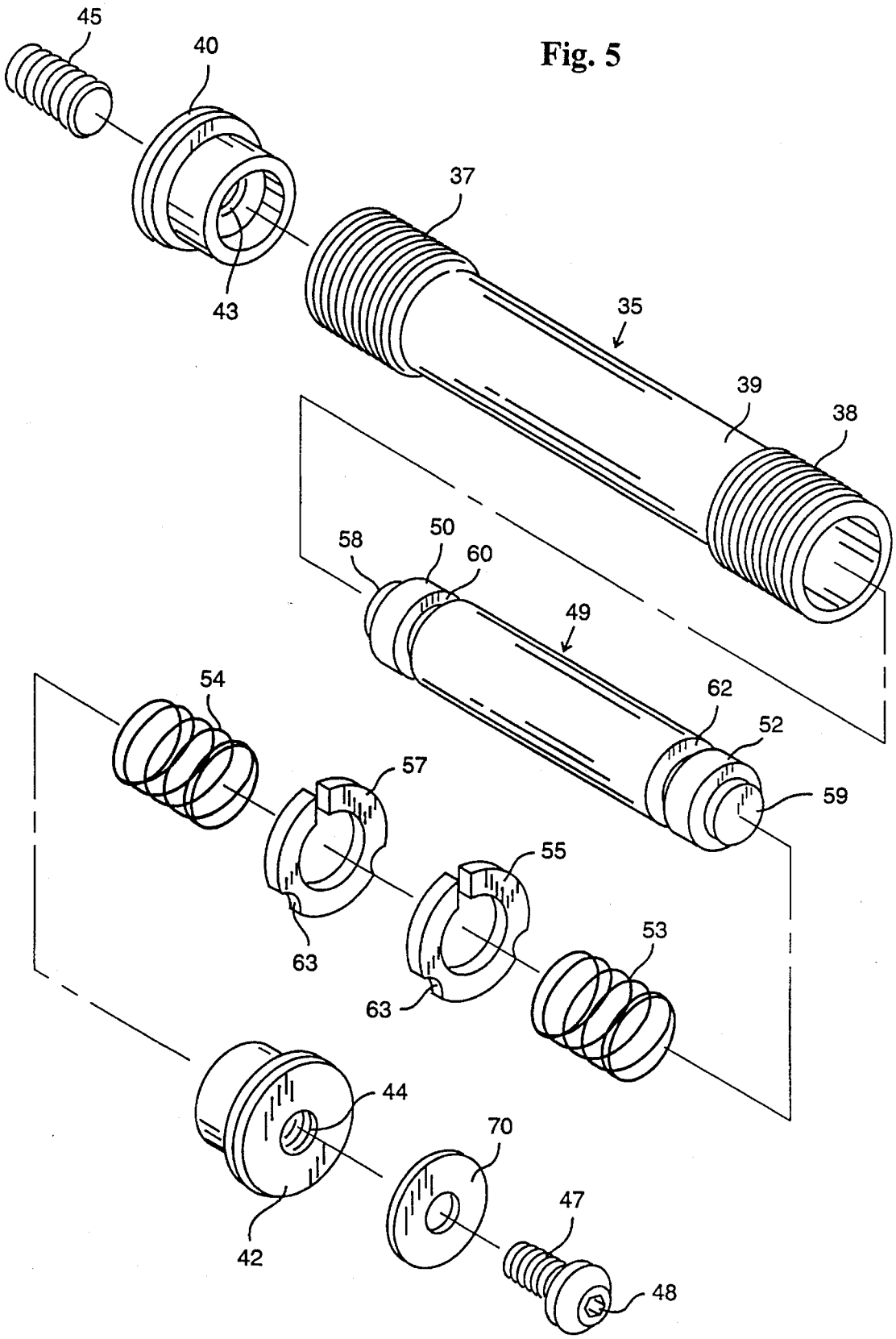
FIG. 5 is an exploded perspective view of the hydraulic component of FIG. 4.

Prior to closing free end 23 with end cap 29, hydraulic component 25 is threaded into housing 20. With additional reference to FIGS. 4 and 5, hydraulic component 25 includes a generally cylindrical weight housing 35 having an inner end 37, an outer end 38, and an outer surface 39. For purposes of this description and with respect to designating ends of various elements, the inner direction refers to a direction towards bow 12 or attachment end 22, and the outer direction refers to a direction towards free end 23. Outer surface 39 of weight housing 35 is threaded at inner end 37 and outer end 38 for engagement with threaded inner surface 24 of housing 20. Inner end 37 is closed by an inner end cap 40 fitted therein. Outer end 38 is closed by an outer end cap 42 fitted therein. Inner end cap 40 and outer end cap 42 are preferably friction fitted into their respective ends, with shrink fitting being the preferred method. Using this method, weight housing 35 would be heated causing expansion thereof, and end caps 40 and 42 would be frozen causing contraction thereof. End caps 40 and 42 are inserted into their respective ends of weight housing 35. Upon cooling, weight housing constricts about end caps 40 and 42 securely holding them in place. One skilled in the art will understand that various alternative methods may be used, such as press fitting end caps 40 and 42 into their respective ends of weight housing 35.

Threaded bores 43 and 44 extend through inner and outer end caps 40 and 42 respectively. A threaded plug 45 is threadably received in and closes bore 43 of inner end cap 40. A screw 47 having an Allen wrench socket 48 is threadably received in and closes bore 44 of outer end cap 42. Screw 47 is substantially permanently threaded into threaded bore 44 by the use of bonding material such as Loctite. Threaded plug 45 is removable to permit weight housing 35 to be filled with fluid such as hydraulic oil. A generally cylindrical weight 49 having an inner end 50 and an outer end 52 is moveably carried within weight housing 35 and substantially freely moveable along longitudinal axis A as will be described presently.

Weight 49 has a substantially shorter length and smaller diameter than weight housing 35 to allow a range of movement therein through the hydraulic oil. This movement is required during shooting of the bow and is relative to a central starting point. Weight 49 is initially positioned centrally within weight housing 35 by centering means consisting of compression springs 53 and 54 and rings 55 and 57. Springs 53 and 54 are placed between inner end cap 40 and inner end 50, and outer end cap 42 and outer end 52, positioning weight 49 along longitudinal axis A. Posts 58 and 59 extend from inner and outer ends 50 and 52 to aid in insuring uniform engagement between the respective ends and springs. Rings 55 and 57 acting as spacer means are carried by grooves 60 and 62 circumscribing the outer surface of weight 49 proximate inner end 50 and outer end 52 respectively. Rings 55 and 57 position weight 49 axially, preventing contact between weight 49 and weight housing 35. To prevent weight 49 from being hydraulically locked in position, 19 channels 63 are formed in the outer edges of rings 55 and 57. Thus, hydraulic oil is able to pass through rings 55 and 57 and around weight 49 permitting longitudinal movement thereof. Free movement of weight 49 controlled by springs is desired, therefore rings 55 and 57 are preferably formed from Teflon, which has a low coefficient of friction, and allows weight 49 to slide freely within weight housing 35.

Figure 6:
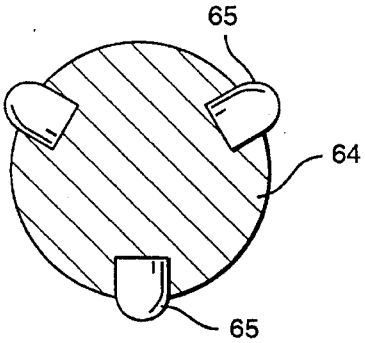
FIG. 6 is a sectional end view illustrating an alternate embodiment of a weight of the hydraulic component.

Turning now to FIG. 6, an alternate embodiment of spacer means is illustrated. In this embodiment a weight 64, substantially identical to weight 49, has a plurality of nubs 65 inserted into its outer surface and extending radially therefrom. Again, Teflon is the preferred material to reduce friction and permit relatively free movement of weight 64. Spacing of nubs 65 permits displacement of hydraulic oil preventing a hydraulic lock from forming.

Referring back to FIGS. 2 and 3, hydraulic component 25 is threadably inserted into housing 20 preferably from free end 23. Once inserted to the desired position within housing 20 by the use of an Allen wrench in engagement with Allen wrench socket 48 of screw 47, hydraulic component 25 is held by a locking member 67 threaded into free end 23 and positioned against outer end 38 of weight housing 35. Locking member 67 includes an Allen wrench socket 68 extending longitudinally therethrough and a cup shaped depression 69 at one end (best seen in FIG. 2) so as to engage outer end cap 42 with the end of screw 47 received therein.

As with housing 20, hydraulic component 25 and locking member 67 are preferably fabricated of aluminum. This, however presents a problem with the interaction between outer end cap 42 and locking member 67. When two aluminum surfaces interact in a moving engagement, a phenomena called "galling" may occur. In the present embodiment this results in locking member 67 bonding to hydraulic component 25 and preventing adjustment or removal thereof. This problem can be overcome by using different materials, such as fabricating locking member 67 from brass. However, in this preferred embodiment, a nylon washer 70 is employed to separate the aluminum surfaces. Briefly referring to FIG. 5, nylon washer 70 is fastened to outer end cap 42 by screw 47. Thus, locking member 67 engages nylon washer 70 locking hydraulic component 25 in position.

Once hydraulic component 25 is properly positioned and locked, end cap 29 is coupled to free end 23. In this manner a specific bow may be stabilized. To make slight balance corrections, dust plug 32 is removed, and an Allen wrench is inserted through access hole 30. First the Allen wrench is used to loosen locking member 67 by engaging Allen wrench socket 68. After sufficient loosening, the Allen wrench is inserted further through Allen wrench socket 68 until it engages Allen wrench socket 48 of screw 47. Further rotation of the Allen wrench will thread hydraulic component 25 toward free end 23 or attachment end 22 as desired. Locking member 67 will not interfere since it is moved by Allen wrench correspondingly with hydraulic component 25. When proper adjustment is made, Allen wrench is removed from Allen wrench socket 48 and used to tighten locking member 67. The Allen wrench is then completely removed and dust plug 32 reinserted to prevent entry of foreign materials. All of the various elements are installable by using a single Allen wrench. This reduces the number of tools necessary and simplifies the process.

Adjustable stabilizer device 10 may also be used on separate bows, being moved from one to the other by unthreading threaded member 33 from one bow and threading into another bow. The above described adjustment process may then be employed to properly stabilize the new bow.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An adjustable stabilizer device for use in combination with a bow, said device comprising:

a tubular housing having an attachment end, a free end, and a threaded interior;

attachment means for attaching said tubular housing to said bow; and a hydraulic component having a threaded exterior configured to threadably engage said threaded interior; wherein said hydraulic component is carried within said tubular housing such that the axial position of said hydraulic component is adjustable between said attachment end and said free end.

2. An adjustable stabilizer device as claimed in claim 1 wherein said hydraulic component is fixed into position within said housing by a locking member threadably received within said housing and engaging said hydraulic component.

3. An adjustable stabilizer device as claimed in claim 2 wherein said locking member has a socket formed therethrough for receiving a tool, and said hydraulic component includes an outer end having a socket formed therein for receiving said tool extending through said locking member.

4. An adjustable stabilizer device as claimed in claim 1 wherein said hydraulic component includes:

a weight housing having an inner end and an outer end;

a weight having an inner end and an outer end, slidably carried within said weight housing; and centering means for centering said weight within said weight housing.

5. An adjustable stabilizer device as claimed in claim 4 wherein said hydraulic component further includes:

an inner end cap having a bore formed therethrough for filling said weight housing with a fluid, said inner end cap coupled to said inner end of said weight housing;

a removable plug receivable within said bore; and an outer end cap coupled to said outer end of said weight housing.

6. An adjustable stabilizer device as claimed in claim 5 wherein said centering means includes:

first biasing means carried between said inner end cap and said inner end of said weight;

second biasing means carried between said outer end cap and said outer end of said weight; and spacer means spacing said weight from an inner surface of said weight housing.

7. An adjustable stabilizer device as claimed in claim 6 wherein said spacer means includes rings carried proximate said inner end and said outer end of said weight, said rings having channels formed therethrough permitting passage of fluid.

8. An adjustable stabilizer device as claimed in claim 6 wherein said spacer means includes a plurality of nubs extending radially outward from said weight.

9. An adjustable stabilizer device as claimed in claim 6 wherein said first and said second biasing means include a first and a second spring respectively.

10. A stabilized bow comprising:

a handle riser having a front, a top end, and a bottom end;

a top limb extending from said top end;

a bottom limb extending from said bottom end;

a tubular housing having a free end, an attachment end removably coupled to said front of said handle riser, and a threaded interior; and a hydraulic component having a threaded exterior configured to threadably engage said threaded interior; wherein said hydraulic component is carried within said tubular housing such that the axial position of said hydraulic component is adjustable between said attachment end and said free end.

11. A stabilized bow as claimed in claim 10 wherein said hydraulic component is fixed into position with said housing by a locking member threadably received within said housing and engaging said hydraulic component.

12. A stabilized bow as claimed in claim 11 wherein said locking member has a socket formed therethrough for receiving a tool, and said hydraulic component includes an outer end having a socket formed therein for receiving said tool extending through said locking member.

13. A stabilized bow as claimed in claim 10 wherein said hydraulic component includes:

a weight housing having an inner end and an outer end;

a weight having an inner end and an outer end, slidably carried within said weight housing; and centering means for centering said weight within said weight housing.

14. A stabilized bow as claimed in claim 13 wherein said hydraulic component further includes:

an inner end cap having a bore formed therethrough for filling said weight housing with a fluid, said inner end cap coupled to said inner end of said weight housing;

a removable plug receivable within said bore; and an outer end cap coupled to said outer end of said weight housing.

15. A stabilized bow as claimed in claim 14 wherein said centering means includes:

first biasing means carried between said inner end cap and said inner end of said weight;

second biasing means carried between said outer end cap and said outer end of said weight; and spacer means spacing said weight from an inner surface of said weight housing.

16. A stabilized bow as claimed in claim 15 wherein said spacer means includes rings carried proximate said inner end and said outer end of said weight, said rings having channels formed therethrough permitting passage of fluid.

17. A stabilized bow as claimed in claim 15 wherein said spacer means includes a plurality of nubs extending radially outward from said weight.

18. A stabilized bow as claimed in claim 15 wherein said first and said second biasing means include a first and a second spring respectively.

19. A method of stabilizing a bow comprising the steps of:

providing an adjustable stabilizer device including:

a tubular housing having an attachment end, a free end, and a threaded interior;

attachment means for attaching said tubular housing to said bow; and a hydraulic component having a threaded exterior configured to threadably engage said threaded interior of said tubular housing;

attaching said adjustable stabilizer device to said bow; and axially adjusting a position of said hydraulic component within said tubular housing to stabilize said bow.

20. A method as claimed in claim 19 further including the step of:

locking said hydraulic component in position.

21. A method as claimed in claim 20 wherein the step of locking said hydraulic component in position includes:

providing a locking member threaded within said tubular housing; and engaging said hydraulic component with said locking member, said locking member having a socket formed therethrough for receiving a tool, and said hydraulic component including an outer end having a socket formed therein for receiving said tool extending through said locking member.

* * * * *